US007077034B2

(12) United States Patent
Harrison

(10) Patent No.: US 7,077,034 B2
(45) Date of Patent: Jul. 18, 2006

(54) ADJUSTABLE SPANNER

(75) Inventor: Ian Austin Harrison, St. Leonards On Sea (GB)

(73) Assignee: HTM Products Ltd. (GB)

( * ) Notice: Subject to any disclaimer, the term of this patent is extended or adjusted under 35 U.S.C. 154(b) by 0 days.

(21) Appl. No.: 10/487,799

(22) PCT Filed: Aug. 22, 2002

(86) PCT No.: PCT/GB02/03878

§ 371 (c)(1),
(2), (4) Date: Sep. 16, 2004

(87) PCT Pub. No.: WO03/018262

PCT Pub. Date: Mar. 6, 2003

(65) Prior Publication Data

US 2005/0016329 A1 Jan. 27, 2005

(30) Foreign Application Priority Data

Aug. 24, 2001 (GB) ..... 0120603

(51) Int. Cl.
*B25B 7/02* (2006.01)

(52) U.S. Cl. ..... 81/145; 81/132; 81/160

(58) Field of Classification Search ..... 81/145, 81/132, 160, 129, 139, 142, 146, 13
See application file for complete search history.

(56) References Cited

U.S. PATENT DOCUMENTS

| | | | | | |
|---|---|---|---|---|---|
| 1,368,580 | A | * | 2/1921 | Sievert | 81/145 |
| 1,397,214 | A | * | 11/1921 | Hose | 81/145 |
| 1,440,381 | A | * | 1/1923 | Edistrom | 81/145 |
| 2,582,591 | A | * | 1/1952 | Hicks | 81/145 |
| 2,850,932 | A | * | 9/1958 | Bonkowski | 81/145 |
| 3,817,128 | A | * | 6/1974 | Evans | 81/145 |

FOREIGN PATENT DOCUMENTS

| | | |
|---|---|---|
| CN | 2063855 U | 10/1990 |
| CN | 2070226 U | 1/1991 |
| FR | 539780 | 6/1992 |

* cited by examiner

*Primary Examiner*—Lee D. Wilson
*Assistant Examiner*—Alvin J. Grant
(74) *Attorney, Agent, or Firm*—Cantor Colburn LLP

(57) ABSTRACT

The present invention relates to an adjustable spanner (2) having a first fixed jaw (4) and a second moveable jaw (8). The second jaw (8) can be locked in fixed relation to the first jaw (4) by a locking means (16). This locking means (16) is moveable between a first position in which the second jaw (8) is fixed in relation to the first jaw (4) and a second position in which the second jaw (8) is permitted to move with respect to the first jaw (4).

17 Claims, 2 Drawing Sheets

ADJUSTABLE SPANNER

TECHNICAL FIELD OF INVENTION

This invention relates to an adjustable spanner.

BRIEF DESCRIPTION OF RELATED ART

Adjustable spanners are well known, and have been used for many years. Typically they comprise a fixed jaw, which is mounted to or formed integrally with a handle, and a moving jaw slidably mounted relative to the fixed jaw. Adjustment is made by means of a worm screw which engages a rack formed on the movable jaw. The problem with this arrangement is that it is cumbersome to use, being difficult to set in situ, and also that it may loosen during use. This frequently results in the spanner slipping from the nut, damaging the nut and sometimes also causing injury to the user's knuckles.

BRIEF SUMMARY OF THE INVENTION

The present invention seeks to overcome or at least alleviate the above problems, and from a first aspect it provides an adjustable spanner comprising:

a first jaw;

a second jaw mounted for slidable movement relative to said first jaw;

a locking member movable between a locking position in which it engages said second jaw so as to lock the second jaw in position relative to the first jaw and a release position in which it releases said second jaw;

biasing means for biasing the locking member towards its locking position; and release means for moving said locking member out of said locking position towards its release position against the force of said biasing means.

In accordance with the invention, therefore, a locking member is biased towards a locking position by biasing means. Release means are provided which allow the locking member to be disengaged from the slidable jaw so as to allow the position of the jaw to be adjusted. Once the jaw is in the desired position, the release means can be released and the jaw then locked in position.

Preferably the locking member and said second jaw have interlocking formations which lock the second jaw in position relative to the first jaw in the event that a force is applied to the second jaw in a direction which tends to increase the separation between the jaws.

Preferably the interlocking formations comprise one or more ratchet teeth provided on the jaw and/or the locking member. With such an arrangement, the tooth or teeth provided on the second jaw can move over the tooth or teeth provided on the locking member relatively easily when the second jaw is moving towards the first jaw to facilitate adjustment. However, when the jaws are in position over a nut, then rotation of the spanner will tend to push the teeth further into engagement, preventing slippage. Most preferably teeth extend along opposed surfaces of the second jaw and the locking member.

Preferably the locking member is arranged to move in a direction generally perpendicular to the direction of movement of the second jaw.

Most preferably the locking member is arranged in a slot which extends in the head of the spanner. Although this slot could extend generally perpendicular to the direction of movement of the second jaw, in the preferred embodiment, the slot extends through the head of the spanner in a direction generally parallel to the direction of movement of the second jaw. Suitable means may be provided for preventing the locking member from falling out of the slot.

In a preferred embodiment, there are provided means for adjustably positioning the locking member within the slot. This is advantageous in that it potentially allows imperial and metric nuts to be gripped tightly. If for example the locking member and sliding jaw are provided with metric spaced teeth, they will allow the jaws closely to grip metric nuts. However, they will not, potentially, allow as firm a grip on imperial nuts, as the spacing between the jaws set for metric nuts may not precisely correspond with the imperial nut size. By being able to adjust the position of the locking member, this difference can be absorbed.

This is an advantageous arrangement in its own right, and may have application to other spanner constructions, so from a further aspect the invention provides an adjustable spanner comprising:

a first jaw;

a second jaw mounted for slidable movement relative to said first jaw;

a locking member movable between a locking position in which it engages said second jaw so as to lock the second jaw in position relative to the first jaw and a release position in which it releases said second jaw;

a slot which receives said locking member and which extends through the head of the spanner in a direction generally parallel to the direction of movement of the second jaw ; and means for adjustably positioning the locking member within the slot.

Preferably the positioning means comprise adjustment screws, and most preferably the adjustment screws are received in a threaded bore extending along the slot receiving the locking member.

Preferably the biasing means of the spanner comprises a spring. The spring need not be of sufficient strength to push the locking member fully home into its locking position but it should bias it towards that position.

The spring may take any suitable form, for example a coil spring, a wire spring or so on. Preferably, however, the spring is a leaf spring. The leaf spring may, for example be bow shaped or generally V-shaped such that as the locking member acts on the spring it deforms.

Suitable means may be provide on the spanner head to locate the biasing means. Preferably, however, the locking member comprises means for locating said biasing means. Such means may comprise, for example a notch or recess receiving a projection formed on the biasing means.

Turning now to the release means, preferably the release means comprises a release member coupled to the locking member and which extends from the spanner for operation by a user. Depending on the strength of the biasing means the release member can also be used to assist the biasing means in locking the locking member in position by a user pushing it in the locking direction.

Preferably the release member comprises a button which extends through an opening such as a slot in a face of the spanner head and which is movable in the direction away from the second jaw to release the locking means.

Preferably the button is screw fitted onto said locking member through said slot.

From a further aspect, the invention provides an adjustable spanner comprising:

a first jaw;

a second jaw mounted for slidable movement relative to said first jaw;

a locking member movable between a locking position in which it engages said second jaw so as to lock the second jaw in position relative to the first jaw and a release position in which it releases said second jaw;

means for moving the locking member between its locking and release positions, said means comprising a member coupled to the locking member and extending out through an opening in a face of the spanner head for manipulation by a user.

Two preferred embodiments of the present invention will now be described by way of example only and with reference to the accompanying drawings wherein:

DETAILED DESCRIPTION OF THE INVENTION

Figure 1:
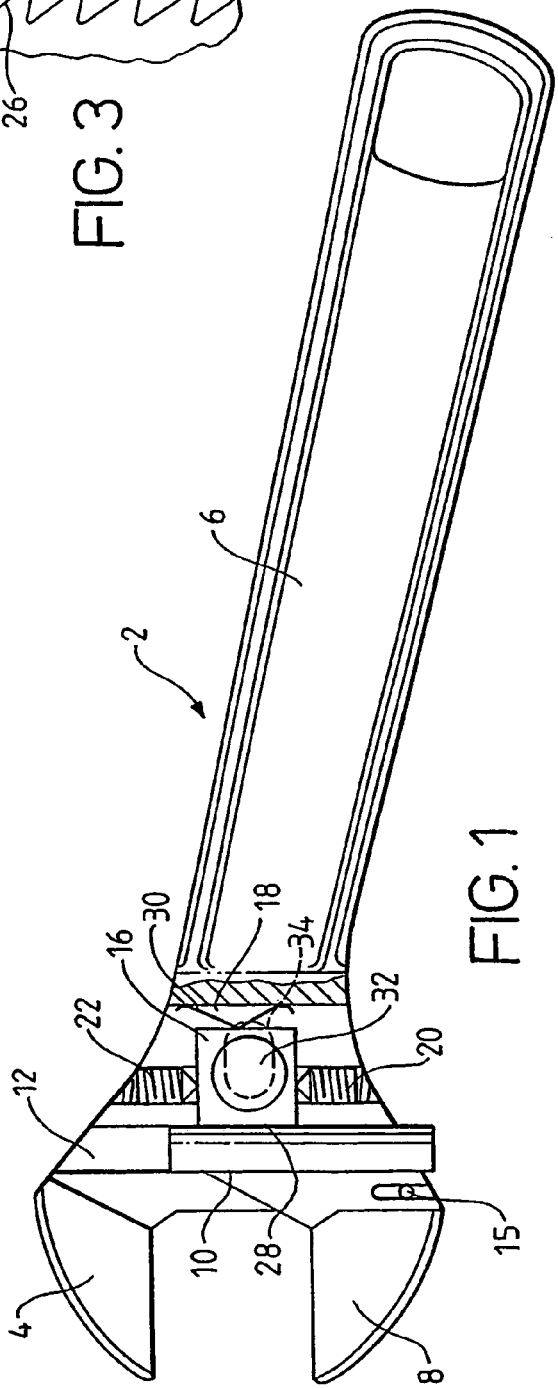
FIG. 1 shows a side view of a first embodiment of the invention in partial section.

With reference to FIG. 1 there is shown an adjustable spanner 2 having a first jaw 4, integral with the handle 6 and second jaw 8 slidable with respect to the first jaw 4. The second jaw 8 has a spigot 10 which is slidably mounted within a bore 12 formed in the head 14 of the spanner 2. The slidable jaw 8 is prevented from falling out by a stop screw 15.

A generally rectangular locking member 16 is moveable in a direction perpendicular to the direction of movement of the second jaw 8 from a locking position in which it engages the second jaw 8 to lock the second jaw 8 in a position relative to the first jaw 4 and a release position in which it releases the second jaw 8.

Figure 2:
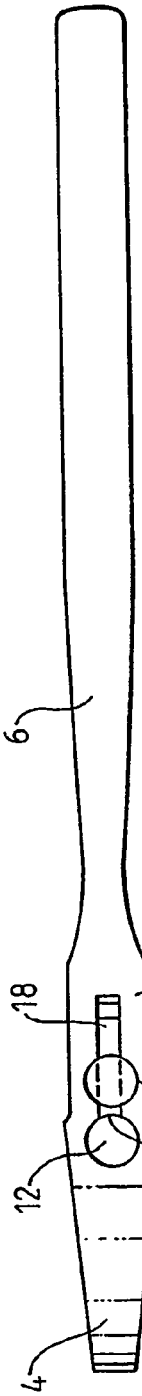
FIG. 2 shows a top view of the spanner.

As can be seen from FIG. 2, the locking member 16 is mounted within a slot 18 extending through the head of the spanner in a direction parallel to the direction of movement of the second jaw 8. The locking member 16 is positioned in a desired position along the slot by virtue of two set screws 20, 22 which are received in a threaded bore 24 extending along the length of the slot 18.

Figure 3:
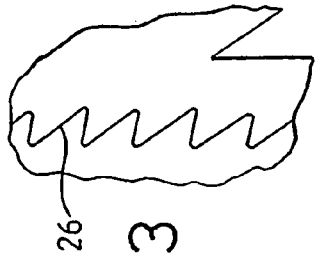
FIG. 3 shows an enlarged view of the teeth profile.

The opposed faces of the locking member 16 and the sliding jaw 8 are provided with sets of interlocking ratchet-like teeth 26, as illustrated in FIG. 3 which engage at the interface 28. The pitch of the teeth 26 may be set at metric, imperial or any other measuring system. By setting the teeth pitch to match a predetermined measuring system, a correct fit will be ensured with a nut sized in the same system. It can be seen from FIG. 3 that the teeth 26 may have a slight backward slope generally which tends to force the locking member 16 further into engagement with the second jaw 8 when a force tending to separate the jaws 4, 8 is applied at the work face, leading to improved grip and preventing slippage of the spanner in use.

A release button 32 is provided which permits the locking member 16 to be released against the biasing force of the spring 30. The release button 32 is fastened e.g. screwed to the locking member 16 and protrudes through a slot 34 in a face of the spanner head 14 as shown in FIG. 2.

In operation, to fit the spanner 2 to a particular nut size, the release button 32 is pulled back in a direction away from the sliding jaw 8 so as to disengage the teeth 26 along the interface 28. In this condition, the jaw 8 can slide freely within the bore 12 and if held in the correctly orientation will fall back against the stop screw 15. The spanner can then be placed over a nut and closed onto the nut by finger pressure. In fact, in order to reduce the gap between the jaws 4, 8 it may not be necessary to pull back the release button 32 as the teeth may move over each other when pushed in this direction.

When the correct size has been reached, the button 32 is released and the teeth 26 move into engagement under the force of the spring 30 and/or by the button 32 being pushed back in that direction.

This firmly locks the locking member against the sliding jaw 8 and thus locks the sliding jaw 8 relative to the fixed jaw 4. When the spanner 2 is rotated in either direction the force generated tends to drive the teeth 26 further into engagement thereby maintaining pressure on the interface and maintaining the locking effect and grip.

If due to the pitch of the teeth 26 a firm grip cannot be obtained on a nut (for example if a metric pitch spanner is used on an imperial size nut, then the set screws 20, 22 can be loosened and tightened to move the locking member 16 slightly in the slot 18 thereby moving the sliding jaw 8 closer to or further away from is the fixed jaw 4.

Figure 4:
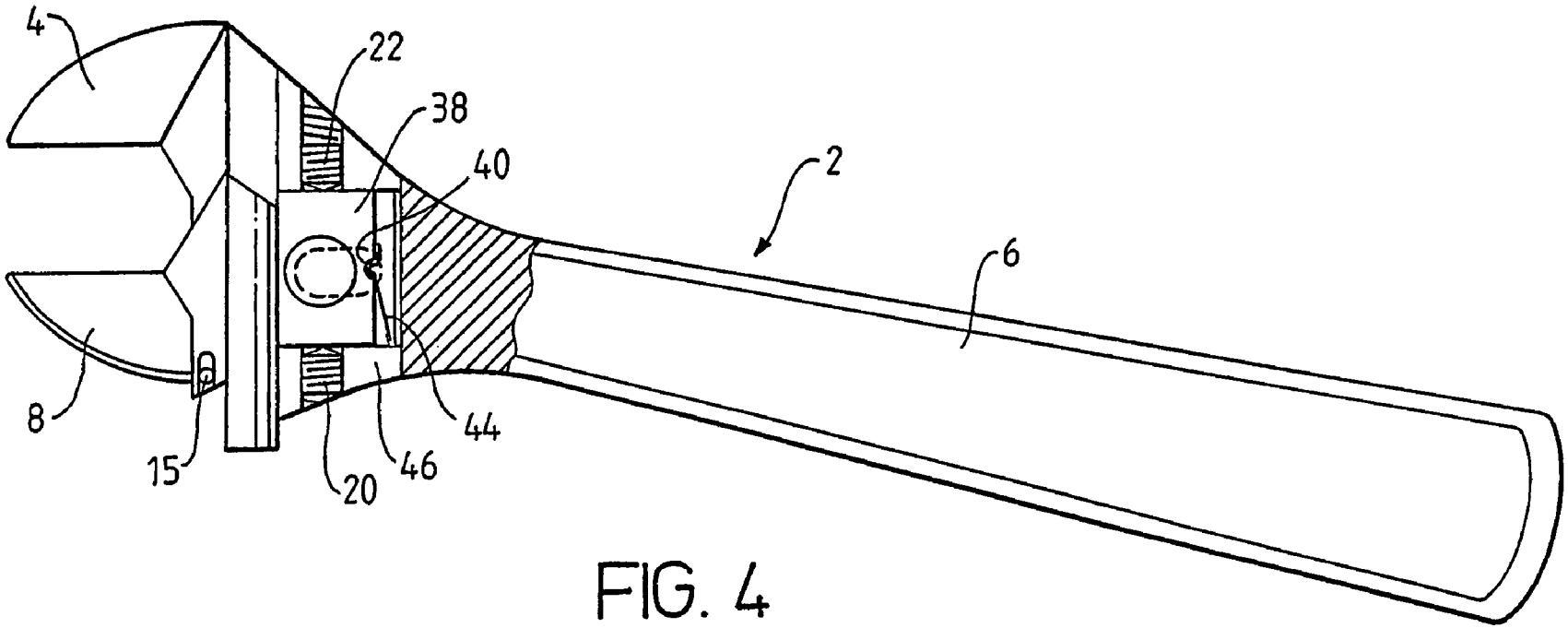
FIG. 4 shows a side view of a second embodiment of the invention.

A second embodiment of the invention is shown in FIG. 4. This is generally similar to the embodiment of FIG. 1, so only the differences will be described here.

In this embodiment, the locking member 38 has a notch 40 formed in its rear surface for receiving a complementary projection 42 formed in a generally V-shaped spring 44 . This notch 40 locates the spring in the slot 46 preventing it falling out.

It will be seen from the above description that the spanner described solves the problems found in the conventional adjustable spanner by locking the jaws precisely to the nut size through the action of the teeth gripping at the interface. The spanner can also very easily be set to another nut size.

What is claimed is:

1. An adjustable spanner comprising:

a first jaw;

a second jaw mounted for slidable movement relative to said first jaw;

a locking member movable between a locking position in which it engages said second jaw so as to lock the second jaw in position relative to the first jaw and a release position in which it releases said second jaw;

biasing means for biasing the locking member towards its locking position; and release means for moving said locking member out of said locking position towards its release position against the force of said biasing means;

said locking member and said second jaw having interlocking ratchet teeth provided thereon;

said ratchet teeth extending along opposed surfaces of the second jaw and the locking member;

wherein the said opposed surfaces are parallel to the direction of movement of the second jaw; and in that said ratchet teeth are backwardly sloped relative to the opposed surfaces, such that in the event that a force is applied to the second jaw in a direction which tends to increase the separation between the jaws the teeth act to force the locking member and the second jaw further into engagement in said locking position.

2. An adjustable spanner as claimed in claim 1, wherein said locking member is arranged to move in a direction generally perpendicular to the direction of movement of the second jaw.

3. An adjustable spanner as claimed in claim 2 wherein said locking member is arranged in a slot which extends through the head of the spanner.

4. An adjustable spanner as claimed in claim 3 wherein said slot extends generally parallel to the direction of movement of the second jaw.

5. An adjustable spanner as claimed in claim 4 comprising means for adjustably positioning said locking member within the slot.

6. An adjustable spanner as claimed in claim 5 wherein said positioning means comprise adjustment screws.

7. An adjustable spanner as claimed in claim 6 wherein said adjustment screws are received in a threaded bore extending along said slot.

8. An adjustable spanner as claimed in claim 1 wherein the biasing means comprises a spring.

9. An adjustable spanner as claimed in claim 8, wherein said spring is a coil spring.

10. An adjustable spanner as claimed in claim 8 wherein said spring is a leaf spring.

11. An adjustable spanner as claimed in claim 10 wherein said leaf spring is bow shaped.

12. An adjustable spanner as claimed in claim 10 wherein said leaf spring is generally V-shaped.

13. An adjustable spanner as claimed in claim 1 wherein said locking member comprises means for locating said biasing means.

14. An adjustable spanner as claimed in claim 13 wherein said location means comprises a notch for receiving a projection formed on the biasing means.

15. An adjustable spanner as claimed in claim 1 wherein said release means comprises a release member coupled to the locking member and which extends from the spanner for operation by a user.

16. An adjustable spanner as claimed in claim 15 wherein the release member comprises a button which extends through a slot in a face of the spanner head and which is movable in the direction away from the second jaw to release the locking means.

17. An adjustable spanner as claimed in claim 16 wherein said button is screw fitted onto said locking member through said slot.

* * * * *